US005311797A

United States Patent [19]

Ruessmann et al.

[11] Patent Number: 5,311,797

[45] Date of Patent: May 17, 1994

[54] PRESSURE-OPERATED POWER WRENCH

[75] Inventors: Klaus Ruessmann, Koenigswinter; Thomas Beyert, Much; Paul-Heinz Wagner, Haus Nr. 70,, D-5103Much-Birrenbachshöhe, all of Fed. Rep. of Germany

[73] Assignee: Paul-Heinz Wagner, Fed. Rep. of Germany

[21] Appl. No.: 29,605

[22] Filed: Mar. 11, 1993

[30] Foreign Application Priority Data

Mar. 31, 1992 [DE] Fed. Rep. of Germany ..... 4210512

[51] Int. Cl.[5] ..... B25B 13/46

[52] U.S. Cl. ..... 81/57.39; 173/218

[58] Field of Search ..... 80/57.39; 173/218, 222

[56] References Cited

U.S. PATENT DOCUMENTS 4,339,968 7/1982 Krieger ..... 81/57.39

4,765,210 8/1988 Mierbach et al. ..... 81/57.39

FOREIGN PATENT DOCUMENTS 0153711 2/1985 European Pat. Off. .

0240931 10/1987 European Pat. Off. .

2182592 10/1986 United Kingdom .

OTHER PUBLICATIONS

Llhydraulik Grundlagen und Anwendung; 7th Edition, VEB Verlag Technik Berlin, 1961, p. 97.

*Primary Examiner*—James G. Smith

*Attorney, Agent, or Firm*—Diller, Ramik & Wight

[57] ABSTRACT

The power wrench has a substantially T-shaped configuration and comprises a transversely extending housing (10) and a headpiece (11) extending centrally therefrom. The housing (10) comprises a working cylinder (17) and an additional cylinder (21). Both cylinders guide a unit (60) having at the one end a working piston (25) and at the other end an additional piston (29). The lever (41) of the headpiece (11) engages in a coupling member (27). The additional cylinder (21) drives the return stroke. Its area is substantially smaller than that of the working cylinder (17), so that the return movement does not require much hydraulic fluid. The headpiece (11) can easily be exchanged. Its lever (41) loosely engages in the coupling member (27) of the unit (60).

6 Claims, 1 Drawing Sheet

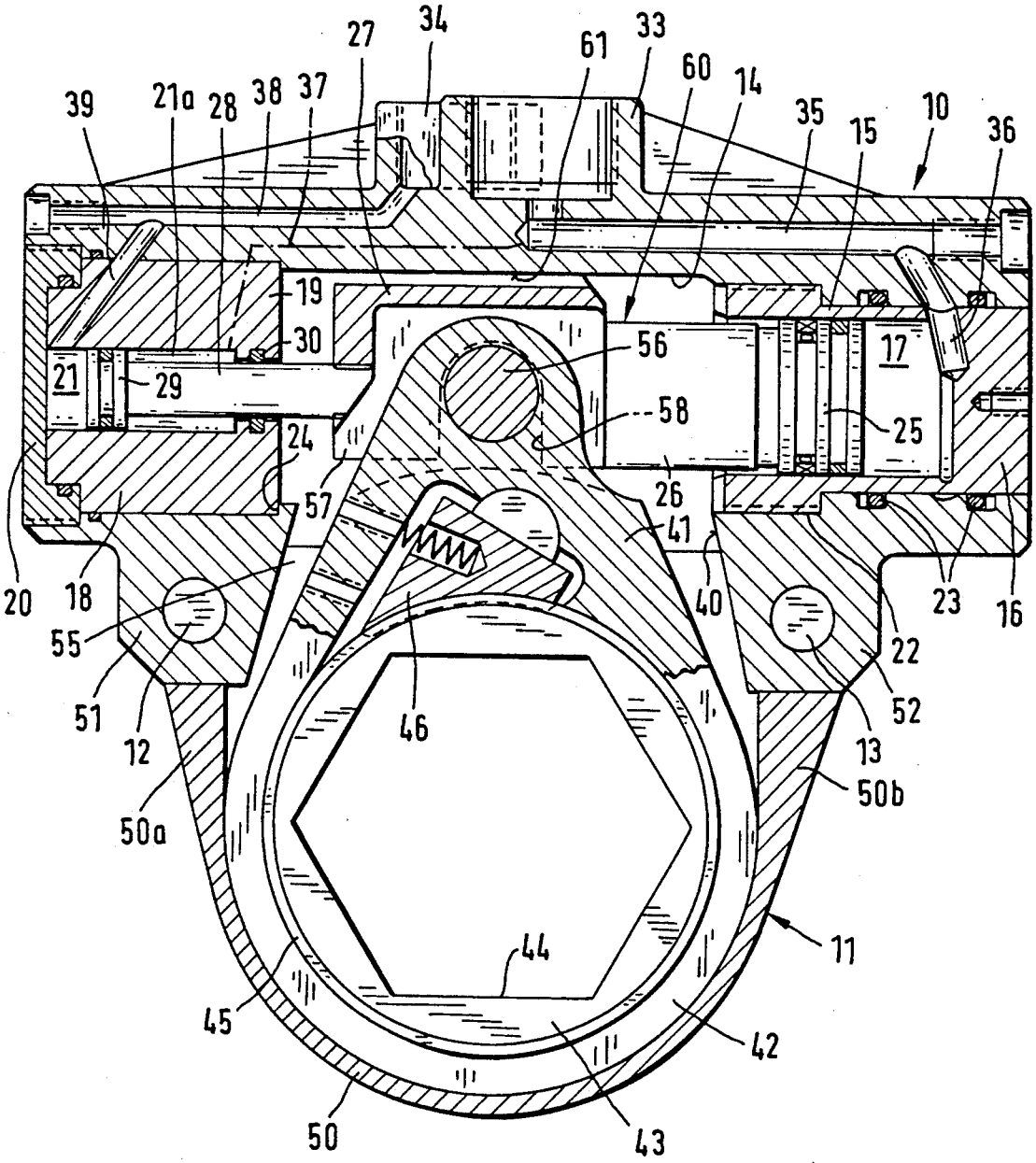
39
21a
28
38
37
27
34
61
33
60
14
35
15
10
36
19
30
21
29
56
58
17
25
24
57
26
41
40
20
18
55
51
12
50a
46
23
16
22
52
13
50b
11
44
45
42
50
43

PRESSURE-OPERATED POWER WRENCH

The invention is directed to a pressure-operated power wrench for turning screws and the like, wherein the rotational force is produced by a working piston movable in a working cylinder.

From European Patent 0,153,711, a power wrench is known in which the housing forming the working cylinder is integrally formed with a headpiece containing a rotatable annular member. A lever acting on the annular member via a ratchet engages in a recess of the working piston to be pivoted thereby in a reciprocating manner. The center of attack of the lever at the piston thereby moves on a tangent to the annular member. The working piston is only pressurized from one side. The return movement is effected by a spring acting on the piston. Such a power wrench is only applicable for a single wrench width or a strongly restricted range of wrench widths. Another drawback is the relatively slow working motion caused by the return spring. If the return spring is strong and produces a great return force, its force has to be overcome by the hydraulic pressure in the working cylinder so that the working stroke begins relatively late and much energy gets lost. If, however, the return spring is relatively soft, the return movement of the working piston and the pressing of the hydraulic fluid out of the working cylinder takes a long time so that the next working stroke starts late.

A similar power wrench is known from European Patent 0,240,931 A1, wherein the working piston moves the lever driving the annular member in the one direction whereas a return spring effects the return movement of the lever. In the case of this power wrench, the speed of the return movement is also limited by the low force of the return spring. The return spring presses the end of the lever against the end of the working piston. The headpiece is a part of the housing containing the working cylinder and cannot be exchanged by the user therein.

Furthermore, power wrenches are known comprising a double-acting working piston, wherein the pressure chamber and the counterpressure chamber of the working piston are alternately pressurized. In this case, the return movement of the working piston is hydraulically effected, the fluid amount required for the return movement of the working piston is not essentially smaller than the fluid amount required for the working stroke.

A power wrench known from British Patent Application 2,182,592 comprises in the driving housing one piston at each of the two sides of a lever, one of which pistons is provided for the working stroke and the other one for the return stroke. Both pistons and the cylinders in which they move have the same dimensions.

From the book "Ölhydraulik", 7th edition, VEB Verlag Technik Berlin, 1961, page 97, a hydropneumatic installation of a machine tool is known in which a hydraulic piston and a pneumatic piston are connected with each other. The cylinder of the hydraulic piston has a smaller diameter than that of the pneumatic cylinder in order to produce a greater force in the hydraulic cylinder. Such an installation functions as pressure amplifier.

It is the object of the invention to provide a pressure-operated power wrench being capable of producing great forces with small structural dimensions and permitting a fast operation mode.

In the power wrench according to the invention, the cross-sectional area of an additional cylinder, which acts as return unit, is essentially smaller than that of the working cylinder. Thereby, it is achieved that substantially less pressure fluid is necessary for the return stroke of the lever than for the working stroke, so that the return stroke takes only a very short period of time. It has to be considered that the feeding pipes, valves and the like leading to the power wrench form flow resistances limiting the flow rate of the pressure medium.

Even in case of high pressures of several hundred bars, it takes a certain time until the required fluid amount enters the respective cylinder. The smaller the volume of this cylinder is, the shorter is the filling duration. Due to the required working force, the working piston must have a relatively large pressure area and thus also a relatively large cylinder diameter. The additional piston, however, which only has to produce the return force, has a smaller diameter, so that the additional cylinder also has a smaller diameter. Thereby, short periods of time for the return movement are possible. The cross sectional area of the additional cylinder is half of the cross-sectional area of the working cylinder at maximum, preferably one third of this cross-sectional area at maximum, and in particular a quarter of this cross sectional area at maximum. Thus, the return time can be reduced to at least a corresponding fraction of the advance stroke time.

The pressurizations of the working cylinder and the additional cylinder are effected in an opposite direction with respect to each other. This means that when the working cylinder is pressurized, the additional cylinder becomes pressureless, and that when the working cylinder becomes pressureless, the additional cylinder is pressurized.

The working cylinder and the additional cylinder, which both have substantially the same length, are preferably arranged in projections of the housing protruding symmetrically to both sides of the plane of symmetry of the headpiece. The plane of symmetry of the headpiece is the plane in which the pivotable lever takes its mid position. Thereby, the power wrench has a substantially T-shaped structure, with the headpiece forming the central member and the two cylinders forming the relatively short side members. Such a power wrench with small dimensions is also applicable at places with difficult access.

The working piston and the additional piston form, together with a coupling member arranged between them, if necessary, preferably an altogether rigid member which is slidingly guided with both ends at the respective cylinder. Thus, a jam-free and secure guidance of the piston is permitted and wear and tear are reduced.

The power wrench according to the invention is preferably a hydraulic power wrench. Basically, however, the principle can also be used with pneumatic pressure media.

Referring to the only FIGURE of the drawing, an embodiment of the invention is described in detail hereinafter.

In the drawing, a longitudinal section of the power wrench is schematically illustrated.

The power wrench comprises an elongated housing 10. A headpiece 11 with two mounting members 12,13 is exchangeably mounted to the central region of the length of the housing. The entity of the housing 10 and the headpiece 11 results in an about T-shaped form of the power wrench.

The elongated housing 10 includes a channel 14 provided with different steps and extending over the entire length. In the one end of the channel 14, a first bush 15 is inserted which is open at one end and comprises a bottom 16 at the other end which is directed to the outside. The interior of the bush 15 forms the working cylinder 17.

A second bush 18 is arranged in the opposite end of the housing 10. This bush 18 comprises a bottom 19 at its end directed toward the housing interior and it is sealingly closed by a cover 20 at its outwardly directed end. The interior of the bush 18 forms the additional cylinder 21.

The channel 14 extending over the entire length of the housing 10 comprises several steps, so that its width reduces more and more in a step-like manner from the left end of the housing to the right end. From the left end, the bush 15 can be introduced into the housing 10 and it is screwed with a thread 22, so that it is non-displaceably fixed in the housing. Seals 23 seal the periphery of the bush 15 against the housing. The bush 18, with its right end, abuts a step 24 of the channel 14 and it is secured against displacements from the opposite end by the cover 20 screwed into the housing.

The working piston 25 is displaceable within the working cylinder 17. The working piston 25 is rigidly connected with a piston rod 26 which comprises a coupling member 27. From the coupling member 27, a piston rod 28 extends to the additional piston 29 displaceable within the additional cylinder 21. The pistons 25 and 29 form together with the piston rods 26 and 28 as well as the coupling member 27 an altogether rigid member 60. The piston rod 28 extends through a sealed bore in the bottom 19 of the bush 18. The two pistons 25 and 29 are arranged along a common axis. The diameter of the working cyliner 17 and the working piston 25 is at least twice as much as the diameter of the additional piston 29 and the additional cylinder 21. The dimensions of the pressure attack areas of these two pistons are thus at least in a ratio 4:1.

While the piston rod 26 of the working piston 25 leads out of the bush 15 without being sealed, the passage of the piston rod 28 through the bottom 19 of the bush 18 is sealed by a seal 30. Thereby, a counterpressure chamber 21*a* is created behind the additional piston 29 in the space surrounding the piston rod 28.

About in the middle of its length, the housing 10 comprises two pressure connectors 33,34 facing away from the headpiece 11 and arranged one after the other in the drawing. The connector 33 is connected via bores 35,36 to the working cylinder 17 and also via bores 37 to the counterpressure chamber 21*a* of the additional cylinder 21. The connector 34 is connected via bores 38 and 39 to the pressure chamber of the additional cylinder 21. The two connectors 33 and 34 are alternately pressurized and made pressureless, one of the connections being pressurized and the other being made pressureless.

About in the middle of its length, the housing 10 comprises a lateral passage opening 40 at the two sides of which the mounting members 12,13 are arranged. The lever 41 of the headpiece 11 protrudes through this passage opening 40. The lever 41 is connected to a bearing ring 42 in which an annular member 43 is pivotably supported. The annular member 43 comprises a polygonal through opening 44 which can be set on a screw head or serves for inserting a socket. The annular member 43 is provided with an outer toothing 45 in which a ratchet element of the bearing ring 42 engages for taking along the annular member 43 only in the one rotational direction of the bearing ring 42. On its part, the bearing ring 42 is supported in the headpiece housing 50. The headpiece housing 50 is substantially U-shaped, the ends of the legs 50*a* and 50*b* extending between fork-shaped projections 51,52 of the housing 10 and being locked there with the two bolt shaped mounting members 12 and 13. These mounting members 12 and 13 can be drawn out to remove the headpiece 11 from the housing 10. The headpiece 11 contains the bearing ring 42 with the protruding lever 41 and the ratchet element 46 as well as the annular member 43. The headpiece 11 can be replaced by another headpiece having a differently shaped or dimensioned opening 44.

The lever 41 protrudes out of a passage opening 55 between the two legs 50*a* and 50*b* of the headpiece housing 50. This lever comprises two bolts 56 extending into two opposite directions and engaging with the coupling member 27. The coupling member 27 is hollow, so that the end of the lever 41 can enter the coupling member 27. In the two opposing side walls 57 of the coupling member 27, slots 58 are provided into which the bolts 56 enter when the headpiece 11 is set to the housing 10 and the lever 41 is guided through the passage opening 40 to engage the coupling member 27. The user of the power wrench can easily detach the headpiece 11 from the housing and exchange it, since the member 60 is not deformed or displaced when detaching the headpiece.

When operating the power wrench, the connector 33 is pressurized, whereas the connector 34 is pressureless and connected to a tank. The pressure in the working cylinder 17 advances the working piston 25, the coupling member 27 taking along the lever 41 and rotating the bearing ring 42 with the annular member 43. The pressure prevailing in the working cylinder 17 is supported by the pressure acting in the counterpressure chamber 21*a* of the additional cylinder 21 so that a force also acts upon the additional piston 29 which force acts in the same direction than that acting upon the working piston 25. During the working stroke, pressure medium is pressed out of the additional cylinder 21 through the bores 39 and 38. After the working stroke has finished, the reversal is effected, the connector 34 being pressurized while the connector 33 is connected with the tank. Thereby, pressure enters the additional cylinder 21, whereby the additional piston 29 is driven to the right. Since the volume of the additional cylinder 21 is essentially smaller than that of the working cylinder 17, only a relatively small amount of hydraulic fluid is required to drive the entire member 60 consisting of the pistons 25,29, the piston rod 26,28 and the coupling member 27, into the retracting position.

In order to prevent that the member 60 is deformed in case of a large load moment, the coupling member 27 is slidably supported at a guide path 61 of the housing 10. This guide path 61 is opposite to the passage opening 40 of the housing 10.

The bushes 15 and 19 wherein high pressure forces prevail and which serve for guiding the pistons are subject to high stresses. They can be easily exchanged. Preferably, these bushes are made of high-quality steel. The housing 10 can be made of a simpler material, for example of pressure diecasting or fiber-reinforced plastic. Due to the fact that the bushes 15 and 18 are enclosed by the housing 10, a burst protection is achieved, as in case of tearing of one bush, this bush is held together by the housing.

We claim:

1. A pressure-operated power wrench comprising a housing (10) which includes a working cylinder (17) with a working piston (25) movable therein, a headpiece (11) being connected to said housing (10) and comprising a rotatable annular member (43) which is coupled, for being taken along by rotation, to a lever (41) engaging said working piston (25), and an additional piston (29) being connected to said working piston (25) and being arranged in an additional cylinder (21) on the side opposite to said working cylinder (17), characterized in that the cross-sectional area of said additional cylinder (21) is substantially smaller than that of said working cylinder (17).

2. The power wrench of claim 1, wherein a duct (37) leading into said working cylinder (17) is connected to a counterpressure chamber (21*a*) of said additional cylinder (21).

3. The power wrench of claim 1, wherein said headpiece (11) is exchangeably mounted to said housing (10) with mounting members (12,13) being arranged at both ends of a passage opening (40) for said lever (41), and wherein said working piston (25) and said additional piston (29) are connected by a coupling member (27) which is engaged by said lever (41) when said headpiece (11) is set to said housing.

4. The power wrench of claim 3, wherein said coupling member (27) is slidably supported at a guiding path (61) of said housing (10).

5. The power wrench of claim 1, wherein said working piston (25) and said additional piston (29) are components of a rigid unit (60) which is guided in said working cylinder (17) and said additional cylinder (29) with both ends.

6. The power wrench of claim 1, wherein said housing (10) comprises two projections extending from said headpiece (11) to opposite sides, which projections substantially have the same length, one thereof comprising said working cylinder (17) and the other comprising said additional cylinder (21).

* * * * *